US007195531B2

(12) United States Patent
Ito et al.

(10) Patent No.: US 7,195,531 B2
(45) Date of Patent: Mar. 27, 2007

(54) IMAGE DISPLAY UNIT AND METHOD FOR MANUFACTURING AN IMAGE DISPLAY UNIT

(75) Inventors: Takeo Ito, Kumagaya (JP); Tsuyoshi Oyaizu, Fukaya (JP); Takashi Nishimura, Fukaya (JP); Satoshi Koide, Fukaya (JP); Hitoshi Tabata, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/436,518

(22) Filed: May 19, 2006

(65) Prior Publication Data

US 2006/0211326 A1 Sep. 21, 2006

Related U.S. Application Data

(62) Division of application No. 10/487,625, filed as application No. PCT/JP02/08490 on Aug. 3, 2002, now Pat. No. 7,075,220.

(30) Foreign Application Priority Data

Aug. 24, 2001 (JP) ..... 2001-255204

(51) Int. Cl.
*H01J 9/22* (2006.01)
*H01J 1/62* (2006.01)
*H01J 63/04* (2006.01)

(52) U.S. Cl. ..... 445/11; 445/13; 445/24; 313/495; 313/496

(58) Field of Classification Search ..... 445/9–13, 445/23, 24, 29, 31, 38–41; 313/461–466, 313/473, 481, 558–562, 553, 495–496
See application file for complete search history.

(56) References Cited

U.S. PATENT DOCUMENTS

| | | | | |
|---|---|---|---|---|
| 5,453,659 | A | 9/1995 | Wallace et al. | |
| 5,866,978 | A * | 2/1999 | Jones et al. | 313/495 |
| 6,278,233 | B1 | 8/2001 | Sanou et al. | 313/495 |
| 6,383,047 | B1 * | 5/2002 | Minami et al. | 445/24 |
| 6,433,487 | B1 | 8/2002 | Yamazaki | 315/169.3 |
| 2001/0041490 | A1 * | 11/2001 | Nomura et al. | 445/24 |

FOREIGN PATENT DOCUMENTS

| | | |
|---|---|---|
| CN | 1134035 A | 10/1996 |
| CN | 1298196 A | 6/2001 |
| EP | 717429 | 6/1996 |
| EP | 1100107 | 5/2001 |
| JP | 2001-195982 | 7/2001 |

* cited by examiner

*Primary Examiner*—Mariceli Santiago
*Assistant Examiner*—Christopher M. Raabe
(74) *Attorney, Agent, or Firm*—Oblon, Spivak, McClelland, Maier & Neustadt, P.C.

(57) ABSTRACT

An image display unit having a structure in which a heat-resisting fine particle layer is formed on a metal back layer disposed on a phosphor layer, and a getter layer is deposited/formed on the heat-resisting fine particle layer by vapor-depositing. The fine particle layer is desirably formed in a specified pattern, and a filmy getter layer is formed in a pattern complementary to the former pattern. The average particle size of heat-resisting fine particles which may use $SiO_2$, $TiO_2$, $Al_2O_3$, $Fe_2O_3$ is 5 nm to 30 μm. Since abnormal discharging is restricted, the destruction and deterioration of an electron emitting element and a phosphor screen are prevented to provide a high-brightness, high-grade display.

8 Claims, 2 Drawing Sheets

IMAGE DISPLAY UNIT AND METHOD FOR MANUFACTURING AN IMAGE DISPLAY UNIT

This is a Divisional application of and is based upon and claims the benefit of priority under 35 U.S.C. §120 from U.S. Ser. No. 10/487,625, filed Feb. 24, 2004; the entire content is incorporated herein by reference.

TECHNICAL FIELD

The present invention relates to an image display unit and a method for manufacturing an image display unit. More specifically, the invention relates to an image display unit having an electron source and a phosphor screen forming an image by irradiation of an electron beam emitted from the electron source within a vacuum envelope and a manufacturing method thereof.

BACKGROUND ART

An image display unit, which displays an image by irradiating an electron beam which is emitted from an electron source to a phosphor material to cause the phosphor material to emit light, generally has the electron source and the phosphor material within a vacuum envelope. When gas (surface adsorption gas) adsorbed to the inner surface of the vacuum envelope is separated to lower a degree of vacuum in the envelope, electrons emitted from the electron source are disturbed from reaching the phosphor material, and a high-brightness image display cannot be made. Therefore, it is necessary to keep the inside of the vacuum envelope under high vacuum.

The gas generated in the envelope is ionized by the electron beam and accelerated by an electric field to collide the electron source, possibly damaging the electron source.

The conventional color cathode-ray tube (CRT) or the like retains a desired degree of vacuum by activating a getter material disposed in the vacuum envelope after sealing and adsorbing the gas released from the inner wall to the getter material during operation. And, it is now being attempted to apply the achievement of a high degree of vacuum and the retention of a degree of vacuum by the getter material to a flat type image display unit.

The flat type image display unit is provided with an electron source which has multiple electron emitting elements arranged on a flat substrate. The capacity of the vacuum envelope is considerably reduced as compared with that of an ordinary CRT, but the surface area of the wall releasing the gas does not be reduced. Therefore, when the surface adsorption gas in a volume similar to that of the CRT is released, deterioration of the degree of vacuum in the vacuum envelope becomes quite substantial. Accordingly, the getter material plays a very important role for the flat type image display unit.

Recently, formation of a layer of the getter material in an image display area is being studied. For example, Japanese Patent Laid-Open Application No. Hei 9-82245 discloses a flat type image display unit having a structure in which a thin film of a getter material having conductivity, such as titanium (Ti), zirconium (Zr) or the like, is overlaid on a metal layer (metal back layer) which is formed on a phosphor layer or the metal back layer itself is comprised of the getter material having the conductivity.

The metal back layer is aimed to enhance brightness by reflecting to the face plate side the light advancing toward the electron source in light emitted from the phosphor material by the electrons emitted from the electron source, to play a role as an anode electrode by imparting conductivity to the phosphor layer, and to prevent the phosphor layer from being damaged by ions generated by ionization of the gas remained in the vacuum envelope.

The conventional field emission display (FED) had a disadvantage that an electric discharge (vacuum arc discharge) was easily caused when images were formed for a long period because a face plate having a phosphor screen and a rear plate having an electron emitting element had a very small gap (space) of one to several millimeters between them, and a high voltage of about 10 kV was applied to the small gap to form a high electric field. And, when such an abnormal electric discharge occurred, a large discharge current in a range of several amperes to several hundred amperes flowed instantaneously, so that there was a possibility that the electron emitting element of a cathode section and the phosphor screen of an anode section were destructed or damaged.

Lately, it is proposed to form a gap section in the metal back layer being used as the anode electrode in order to ease the damage resulting from the occurrence of an abnormal electric discharge. An image display unit configured to have the metal back layer coated with a getter layer having conductivity is proposed to have a gap in the getter layer by forming the getter layer in a specified pattern in order to additionally restrict the occurrence of electric discharge so as to improve a withstand pressure characteristic.

Conventionally, as a method of forming the getter layer having a specified pattern, there is proposed a method of disposing a mask having a pore pattern on a metal back layer and forming the getter layer by a vacuum-deposition method or a sputtering method. But, this method has disadvantages that patterning accuracy, pattern fineness and the like are limited, and an advantageous effect of preventing an electric discharge to improve the withstand pressure characteristic is not sufficient.

The present invention has been made to remedy the above disadvantages and provides an image display unit capable of providing a high-brightness, high-grade display with electron emitting elements and a phosphor screen prevented from being destructed or deteriorated by electric discharge, and a manufacturing method thereof.

SUMMARY OF THE INVENTION

A first aspect of the present invention is an image display unit comprising a face plate, an electron source disposed to oppose the face plate, and a phosphor screen formed on the inner surface of the face plate, wherein the phosphor screen has a phosphor layer which emits light by an electron beam emitted from the electron source, a metal back layer formed on the phosphor layer, a heat-resisting fine particle layer formed on the metal back layer and a getter layer formed on the heat-resisting fine particle layer.

The image display unit can have the heat-resisting fine particle layer in a specified pattern and can have a filmy getter layer in an area, where the heat-resisting fine particle layer is not formed, on the metal back layer. And, the phosphor screen can have a light absorption layer for separating the individual phosphor layers, and the heat-resisting fine particle layer formed in at least a part of the area located above the light absorption layer.

And, the heat-resisting fine particles can have an average particle size of 5 nm to 30 μm. The heat-resisting fine particles can be fine particles of at least one type of metal oxide selected from a group consisting of $SiO_2$, $TiO_2$, $Al_2O_3$ and $Fe_2O_3$. The getter layer can be a layer of at one type of metal selected from a group consisting of Ti, Zr, Hf, V, Nb, Ta, W and Ba or an alloy mainly consisting of such metals. Besides, the electron source can have plural electron emitting elements disposed on a substrate. Furthermore, the metal back layer can have a removed portion or a high resistance portion in prescribed regions.

A second aspect of the present invention is a method for manufacturing an image display unit comprising forming a phosphor screen, which has a phosphor layer and a metal back layer coated on the phosphor layer, on the inner surface of a face plate, and disposing the phosphor screen and an electron source in a vacuum envelope, further comprising forming a heat-resisting fine particle layer on the metal back layer, and a step of forming a layer of a getter material by vacuum-depositing the getter material on the metal back layer from above the heat-resisting fine particle layer.

The method for manufacturing an image display unit according to the second aspect can have forming a heat-resisting fine particle layer in a specified pattern on the metal back layer in the heat-resisting fine particle layer forming step, and forming a filmy getter layer in an area, where the heat-resisting fine particle layer is not formed, on the metal back layer. And, the phosphor screen can have a light absorption layer for separating the individual phosphor layers and the heat-resisting fine particle layer formed in at least a part of the area located above the light absorption layer on the metal back layer.

And, the heat-resisting fine particles can have an average particle size of 5 nm to 30 μm. The heat-resisting fine particles can be fine particles of at least one type of metal oxide selected from a group consisting of $SiO_2$, $TiO_2$, $Al_2O_3$ and $Fe_2O_3$. And, the getter material can be at least one type of metal selected from a group consisting of Ti, Zr, Hf, V, Nb, Ta, w and Ba or an alloy mainly consisting of such metals. Besides, the electron source can have plural electron emitting elements disposed on a substrate. Besides, forming the phosphor screen can comprise forming a metal back layer having a removed portion or a high resistance portion in prescribed regions.

The image display unit of the invention has a layer of the heat-resisting fine particles having a prescribed particle size (e.g., an average particle size of 5 nm to 30 μm) on the metal back layer of the phosphor screen and a layer of the getter material formed on the heat-resisting fine particle layer by, for example, vapor-depositing. The surface of the heat-resisting fine particle layer has fine unevenness because of the outside shapes of the fine particles, so that a film forming property of the getter material to be deposited on the layer becomes considerably poor. Therefore, a continuous uniform getter material film (getter film) is not formed on the heat-resisting fine particle layer, and the getter material is simply adhered/deposited. Therefore, the getter film is formed on only areas, where the heat-resisting fine particle layer is not formed, of the metal back layer.

And, because the getter film having the pattern is formed as described above, the occurrence of electric discharge is restricted and the peak value of a discharge current is suppressed if electric discharge occurs in especially a flat type image display unit such as the FED, so that the electron emitting elements or the phosphor screen is prevented from being destructed, damaged or deteriorated.

In the method for manufacturing an image display unit of the present invention, when a method of vapor-depositing the getter material from the above of the pattern of the heat-resisting fine particle layer after the heat-resisting fine particle layer is formed in a specified pattern is adopted, the getter material-deposited film is formed on areas, where the heat-resisting fine particle layer is not formed, of the metal back layer, and the getter film having the pattern of the heat-resisting fine particle layer and the inversion pattern can be formed. And, by forming the getter film having the pattern as described above, especially the flat type image display unit such as the FED can restrict the occurrence of electric discharge and suppress the peak value of discharge current if electric discharge occurs, and the electron emitting elements or the phosphor screen can be prevented from being destructed, damaged or deteriorated.

And, the pattern of the heat-resisting fine particle layer can be formed in high fineness and high precision by a screen printing method or the like, so that the getter film in its reverse pattern can also be formed in high fineness and high precision.

BEST MODE FOR CARRYING OUT THE INVENTION

Figure 1:
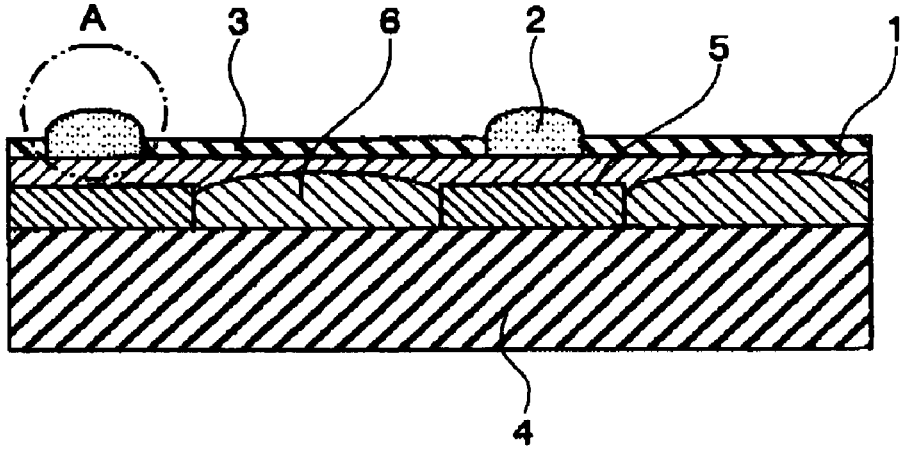
FIG. 1 is a sectional diagram showing a structure of a getter film-attached phosphor screen formed according to the first embodiment of the invention.

Preferred embodiments of the invention will be described. It is to be understood that the invention is not limited to the following embodiments.

In the first embodiment, a light absorption layer made of a black pigment is first formed in a specified pattern (e.g., stripes) on the inner surface of a glass substrate which is to be a face plate by photolithography or a printing method. A ZnS-based, $Y_2O_3$-based or $Y_2O_2S$-based phosphor liquid is applied onto the light absorption layer by a slurry method or the like and dried, then patterning is made by the photolithography to form a three-color phosphor layer of red (R), green (G) and blue (B). The phosphor layer of individual colors can also be formed by a spray method or a printing method. When the spray method or the printing method is used, the patterning by the photolithography is also used, if necessary.

Then, a metal back layer is formed on the phosphor screen having the light absorption layer and the phosphor layer formed as described above. To form the metal back layer, there can be adopted, for example, a method by which a metal film of aluminum (Al) or the like is formed by vacuum-depositing on a thin film of an organic resin such as nitrocellulose formed by the spin method, and organic substances are removed by additional baking. The metal back layer can also be formed using a transfer film as described below.

The transfer film has a structure in that a metal film of Al or the like and an adhesive agent layer are superposed sequentially on a base film with the parting agent layer (and also a protective film, if necessary) intervening therebetween. This transfer film is disposed so to contact the adhesive agent layer with the phosphor layer and pressurized. A stamp method, a roller method or the like is available as a pressing method. Thus, the transfer film is pressed to adhere the metal film, and the base film is peeled so as to transfer the metal film to the phosphor screen.

Then, a heat-resisting fine particle layer is formed on the metal back layer (metal film) formed as described above to have a specified pattern by a screen printing method or the like. The area where the heat-resisting fine particle layer pattern is formed can be determined on, for example, an area located on the light absorption layer. When the heat-resisting fine particle layer is formed in the above-described pattern avoiding the phosphor layer, there is an advantage that lowering of brightness because of the absorption of an electron beam from the electron source by the fine particle layer is small.

Material configuring the heat-resisting fine particles is not limited to a particular one but can be any type as long as it has insulating properties and can resist heating at a high temperature in a sealing step or the like. For example, fine particles of a metal oxide such as $SiO_2$, $TiO_2$, $Al_2O_3$ or $Fe_2O_3$ are available, and such metal oxides can be used alone or in a combination of two or more of them.

These heat-resisting fine particles desirably have an average particle size of 5 nm to 30 μm, and more desirably 10 nm to 10 μm. When the fine particles have an average particle size of less than 5 nm, the surface of the fine particle layer is substantially free from unevenness and very smooth. Thus, a getter material-deposited film is also formed uniformly without interruption on the heat-resisting fine particle layer. Therefore, a patterned getter film cannot be formed. When the fine particles have an average particle size of exceeding 30 μm, it becomes impossible to form a heat-resisting fine particle layer.

Then, a metal back-attached phosphor screen where the heat-resisting fine particle layer is patterned is disposed together with the electron source in the vacuum envelope. There is adopted a method of forming a vacuum vessel by vacuum-sealing a face plate having the phosphor screen and a rear panel having the electron source such as plural electron emitting elements with flit glass or the like.

The getter material is then vapor-deposited from above the heat-resisting fine particle layer pattern in the vacuum envelope to form the getter material-deposited film in areas of the metal back layer where the heat-resisting fine particle layer is not formed. For the getter material, a metal selected from Ti, Zr, Hf, V, Nb, Ta, W and Ba, or an alloy mainly containing at least one of such metals.

Figure 2:
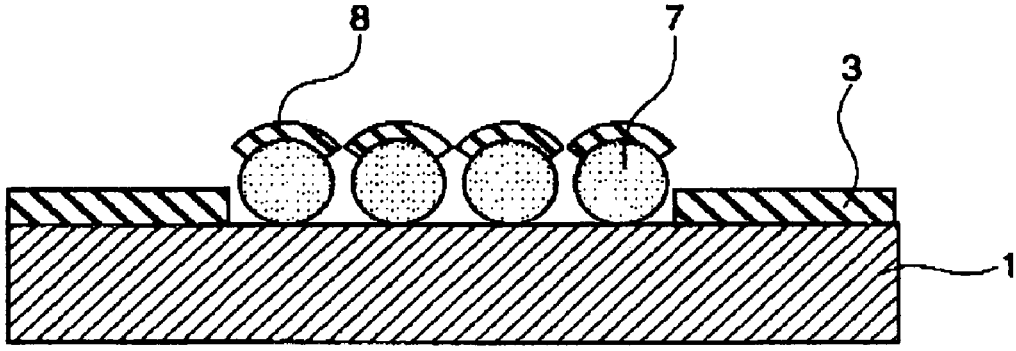
FIG. 2 is a sectional diagram showing part A of FIG. 1 in an enlarged form.

Thus, a getter film 3 having a reverse pattern of a pattern of a heat-resisting fine particle layer 2 is formed on a metal back layer 1 of Al or the like as shown in FIG. 1. FIG. 1 shows a cross section of the metal back-attached phosphor screen formed according to the first embodiment. In FIG. 1, reference numeral 4 denotes a glass substrate, 5 denotes a light absorption layer, and 6 denotes a phosphor layer. FIG. 2 is an expanded view of part A of FIG. 1. In FIG. 2, reference numeral 7 denotes heat-resisting fine particles, and 8 denotes a getter material deposited on the heat-resisting fine particles 7.

After the getter material is deposited, the getter film 3 is kept retained in a vacuum atmosphere in order to prevent it from deteriorating. Therefore, it is desirable that, after the heat-resisting fine particle layer 2 is patterned on the metal back layer 1, the phosphor screen is disposed in the vacuum envelope, and the getter material is deposited in the vacuum envelope.

Figure 3:
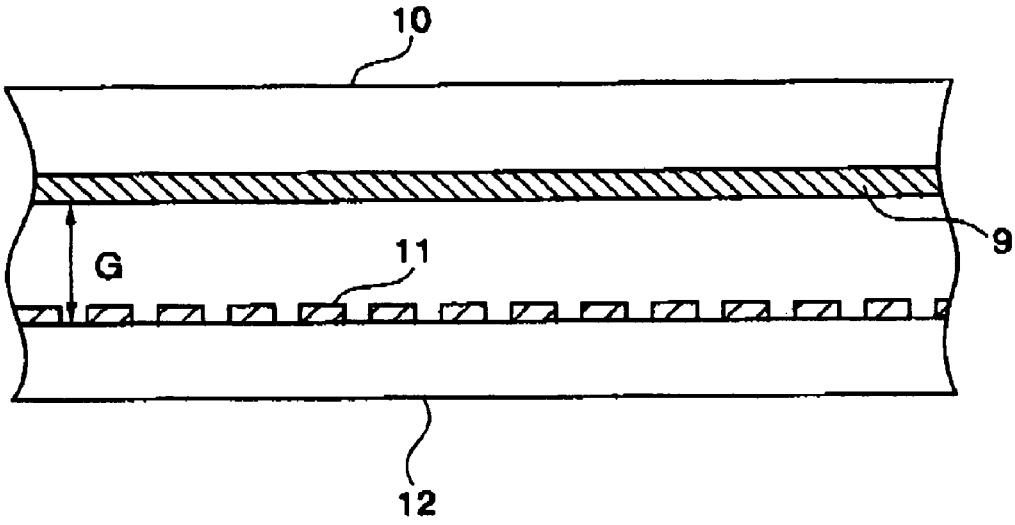
FIG. 3 is a sectional diagram schematically showing a structure of an FED having as an anode electrode the getter film-attached phosphor screen according to the first embodiment.

The structure of an FED having the phosphor screen on which the getter film is patterned is shown in FIG. 3. This FED is configured in that a face plate 10 having a getter film-attached phosphor screen 9 and a rear plate 12 having multiple electron emitting elements 11, which are arranged in matrix, are disposed to oppose each other with a narrow gap (space) G of about one to several millimeters between them, and a high voltage of 5 to 15 kV is applied to the very small gap G between the face plate 10 and the rear plate 12.

Electric discharge (dielectric breakdown) occurs easily in the gap G between the face plate 10 and the rear plate 12 because the gap G is very small, but the peak value of discharge current is suppressed if an electric discharge occurs in the FED formed in the embodiment, and instantaneous concentration of energy is avoided. And, the electron emitting elements and the phosphor screen are prevented from being destructed, damaged or deteriorated because the maximum value of discharge energy is reduced.

Figure 4:
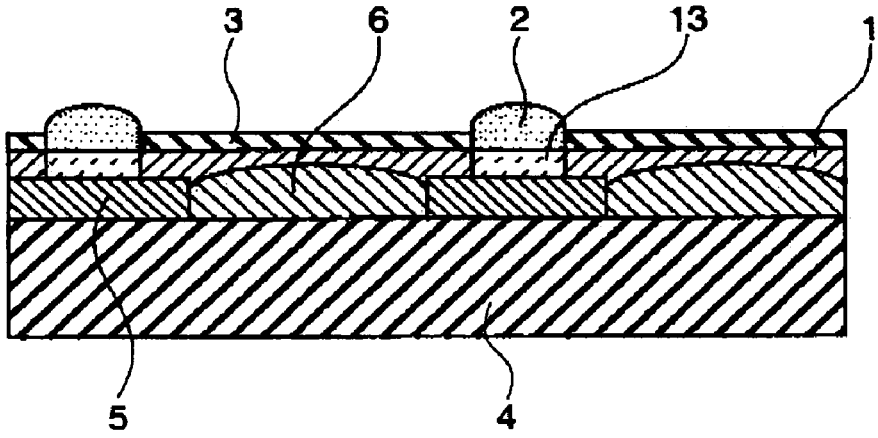
FIG. 4 is a sectional diagram showing a structure of the getter film-attached phosphor screen according to the second embodiment.

It was described in the first embodiment that the structure had the metal back layer continuously formed without any gap or a separated part. But, the image display unit of the invention is not limited to the described structure. As the second embodiment, the metal back layer 1 may be cut or made to have high resistance at prescribed locations on the light absorption layer 5 or the like as shown in FIG. 4. Removed portions or high resistance portions 13 can be formed in the metal back layer 1 by a method of applying a liquid for dissolving or oxidizing the metal to the metal back layer 1, a method of cutting the metal back layer 1 by laser, or a method of forming a pattern of the metal back layer by depositing with a mask.

And, in the structure having conduction interrupted by the removed portions or the high resistance portions 13 of the metal back layer 1 as described above, electric discharge is further restricted and a withstand voltage characteristic is improved, so that an image having high brightness without suffering from deterioration of brightness can be obtained.

Then, specific examples of applying the invention to the FED will be described.

EXAMPLE 1

A light absorption layer (light-shielding layer) consisting of a black pigment was formed in a stripe form on a glass substrate by a photolithography, and a three color phosphor layer of red (R), green (G) and blue (B) was formed to have stripe patterns between the adjacent patterns of the light absorption layer by the photolithography. Thus, a phosphor screen having the light absorption layer and the phosphor layer with the specified patterns was formed.

Then, an Al film was formed as a metal back layer on the phosphor screen. Specifically, an organic resin solution mainly containing an acryl resin was applied to and dried on the phosphor screen to form an organic resin layer, an Al resin was formed thereon by vacuum-depositing, and heating was performed for baking at a temperature of 450° C. for 30 minutes so as to decompose and remove an organic component.

Next, a silica paste consisting of 5 wt % of silica ($SiO_2$) fine particles (particle size of 10 nm), 4.75 wt % of ethyl cellulose and 90.25 wt % of butyl carbitol acetate was screen-printed on the Al film using a screen mask having openings at locations just above the light absorption layer. Thus, a pattern of the $SiO_2$ layer was formed on an area just above the light absorption layer.

Ba was then deposited on the $SiO_2$ layer in a vacuum atmosphere. As a result, Ba was deposited as the getter material on the $SiO_2$ layer but did not form a uniform film. A uniform deposited film of Ba as the getter material was formed on the areas, where the $SiO_2$ layer was not formed, of the Al film. Thus, the getter film having a reverse pattern of the pattern of the $SiO_2$ layer was formed on the Al film.

Surface resistivity of the getter film was measured in a state that a vacuum atmosphere was retained. The measured result is shown in Table 1.

An FED was produced by a common procedure using a panel having the patterned $SiO_2$ layer, on which the getter film was not deposited, as a face plate. First, an electron generation source, which had multiple surface conduction type electron emitting elements formed in matrix on a substrate, was fixed to a glass substrate to produce a rear plate. Then, the rear plate and the above-described face plate were opposed to each other with a support frame and a spacer between them and sealed with flit glass to produce a vacuum envelope. The face plate and the rear plate had a gap of 2 mm between them. Subsequently, the vacuum envelope was evacuated, and Ba was deposited toward the panel surface (the metal back-attached phosphor screen with the patterned $SiO_2$ layer formed) to form the getter film in the reverse pattern of the pattern of the $SiO_2$ layer on the Al film.

The FED obtained by Example 1 was determined for evaluation of its withstand voltage characteristic by a common procedure. In addition, fineness of the getter film pattern and a degree of electrical disconnection between the patterns were examined. The determined results are shown in Table 1.

The withstand voltage characteristic of the FED was evaluated by: ⊚ indicating that a withstand voltage is high and a withstand voltage characteristic is quite good, ○ indicating that a withstand voltage characteristic is good, Δ indicating that a withstand voltage characteristic is not good practically, and X indicating that a withstand voltage characteristic is defective and impractical. Fineness of the getter film pattern was evaluated by: ⊚ indicating that the pattern has very high fineness, ○ indicating that fineness is high, Δ indicating that fineness is low and is not good practically, and X indicating that fineness is very low. A degree of electrical disconnection between patterns was evaluated by: ⊚ indicating that electrical disconnection between patterns is complete, ○ indicating that electrical disconnection is good, Δ indicating that electrical disconnection is made somehow or other, and X indicating that electrical disconnection is defective.

EXAMPLE 2

An Al film was formed on a phosphor screen formed in the same way as in Example 1, and a paste consisting of 10 wt % of $Al_2O_3$ fine particles having a particle size of 7 μm, 4.75 wt % of ethyl cellulose and 85.25 wt % of butyl carbitol acetate was screen-printed on the Al film to form a pattern of the $Al_2O_3$ layer.

Then, Ba was deposited on the formed pattern of the $Al_2O_3$ layer in the same way as in Example 1 to form a getter film (Ba film) having a reverse pattern of the pattern of the $Al_2O_3$ layer. Surface resistivity of the getter film was measured in a state that a vacuum atmosphere was retained. The measured result is shown in Table 1.

Using a panel having the patterned $Al_2O_3$ layer, on which the getter film was not deposited, as the face plate, an FED was produced in the same way as in Example 1. The withstand voltage characteristic of the obtained FED was determined for evaluation by a common procedure. And, fineness of the getter film pattern and a degree of electrical disconnection between the patterns were examined in the same way as in Example 1. The determined results are shown in Table 1.

Besides, as Comparative Example 1, the getter film was formed on the entire surface of the Al film by depositing Ba on the Al film of the phosphor screen without forming a pattern of an $SiO_2$ layer or an $Al_2O_3$ layer as the heat-resisting fine particle layer. As Comparative Example 2, a pattern of the getter film was formed by depositing Ba on the Al film of the phosphor screen with a mask having openings in portions just above the phosphor layer interposed.

Then, surface resistivity of the getter films obtained in Comparative Examples 1 and 2 were measured in a state that a vacuum atmosphere was retained. And, using the panels, on which the getter films were not deposited, as the face plates, FEDs were produced in the same way as in Example 1. Withstand voltage characteristic of the obtained FEDs, fineness of the getter film patterns and a degree of electrical disconnection between the patterns were examined in the same way as in Example 1. The results are shown in Table 1.

TABLE 1

| | Example 1 | Example 2 | Comparative Example 1 | Comparative Example 2 |
|---|---|---|---|---|
| Heat-resisting fine particles (particle size) | $SiO_2$ (10 nm) | $Al_2O_3$ (7 μm) | None | None |
| Surface resistivity of getter film | $10^4\Omega/\square$ | $10^4\Omega/\square$ | $10^2\Omega/\square$ | $10^0\Omega/\square$ |
| Fineness of getter film pattern | ⊚ | ○ | X | — |
| Disconnection between getter film patterns | ○ | ○ | ○ | — |
| Withstand voltage characteristic | ⊚ | ○ | Δ | X |

It is evident from the results shown in Table 1 that in Examples 1 and 2 the getter films having a pattern with remarkable fineness and favorable electrical disconnection were formed. And, the obtained getter films have higher surface resistance as compared with those of Comparative Examples, and FEDs having a good withstand voltage characteristic can be realized.

In the Examples described above, the direct vapor deposition method called a lacquer method was used to form the metal back layer, but the same effects can be obtained by using the transfer method to form the metal back layer.

INDUSTRIAL APPLICABILITY

As described above, the electrically divided getter layer can be formed readily on the metal back layer of the phosphor screen according to the present invention. And, the getter film having a very fine and highly accurate pattern can be formed, so that the peak value of discharge current can be suppressed in case of occurrence of electric discharge in a flat type image display unit such as the FED, and the electron emitting elements or the phosphor screen can be prevented from being destructed, damaged or deteriorated.

What is claimed is:

1. A method for manufacturing an image display unit comprising:

forming a phosphor screen, which has a phosphor layer and a metal back layer coated on the phosphor layer, on the inner surface of a face plate, and disposing the phosphor screen and an electron source in a vacuum envelope, further comprising:

forming a heat-resisting fine particle layer on the metal back layer, and forming a layer of a getter material by vacuum-depositing the getter material on the metal back layer from above the heat-resisting fine particle layer.

2. The method for manufacturing an image display unit according to claim 1, wherein the heat-resisting fine particle layer is formed in a specified pattern on the metal back layer in the forming of the heat-resisting fine particle layer, and a filmy getter layer is formed on areas, where the heat-resisting fine particle layer is not formed, of the metal back layer in the forming of the getter layer.

3. The method for manufacturing an image display unit according to claim 1, wherein the phosphor screen has a light absorption layer for separating the individual phosphor layers, and the heat-resisting fine particle layer is formed in at least a part of the area, which is located above the light absorption layer, of the metal back layer in the forming of the heat-resisting fine particle layer.

4. The method for manufacturing an image display unit according to claim 1, wherein the heat-resisting fine particles have an average particle size of 5 nm to 30 μm.

5. The method for manufacturing an image display unit according to claim 1, wherein the heat-resisting fine particles are fine particles of at least one type of metal oxide selected from a group consisting of $SiO_2$, $TiO_2$, $Al_2O_3$ and $Fe_2O_3$.

6. The method for manufacturing an image display unit according to claim 1, wherein the getter material is at least one type of metal selected from a group consisting of Ti, Zr, Hf, V, Nb, Ta, W and Ba or an alloy mainly consisting of such metals.

7. The method for manufacturing an image display unit according to claim 1, wherein the electron source has plural electron emitting elements disposed on a substrate.

8. The method for manufacturing an image display unit according to claim 1, wherein forming the phosphor screen comprises forming a metal back layer having a removed portion or a high resistance portion in prescribed regions.

* * * * *